US007950977B2

(12) United States Patent
Sun et al.

(10) Patent No.: US 7,950,977 B2
(45) Date of Patent: May 31, 2011

(54) VEHICLE LAUNCHER ASSEMBLY

(75) Inventors: Steed Sun, San Gabriel, CA (US); Binh Luong, Kowloon (HK); Peter Fan, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 296 days.

(21) Appl. No.: 12/210,515

(22) Filed: Sep. 15, 2008

(65) Prior Publication Data

US 2009/0075556 A1 Mar. 19, 2009

Related U.S. Application Data

(60) Provisional application No. 60/972,798, filed on Sep. 15, 2007.

(51) Int. Cl.
*A63H 17/00* (2006.01)
*A63H 17/26* (2006.01)
*A63H 29/00* (2006.01)

(52) U.S. Cl. ..... 446/435; 446/470; 446/429

(58) Field of Classification Search ..... 446/4, 6, 446/78, 429–431, 435, 436, 465, 470, 473; 273/108, 129 R, 129 M; 124/16, 56
See application file for complete search history.

(56) References Cited

U.S. PATENT DOCUMENTS

| | | | | |
|---|---|---|---|---|
| 4,192,093 | A * | 3/1980 | Hamano | 446/427 |
| 4,236,345 | A * | 12/1980 | Inoue | 446/197 |
| 4,249,339 | A * | 2/1981 | Crain et al. | 446/231 |
| 4,382,347 | A * | 5/1983 | Murakami | 446/433 |
| 4,464,860 | A | 8/1984 | Onodera | |
| 4,504,239 | A | 3/1985 | Kulesza | |
| 4,529,389 | A | 7/1985 | Kennedy | |
| 4,685,894 | A * | 8/1987 | Beny et al. | 446/435 |
| 4,737,135 | A | 4/1988 | Johnson | |
| 5,334,078 | A * | 8/1994 | Hippely et al. | 446/470 |
| 5,807,158 | A * | 9/1998 | Tsai | 446/470 |
| 5,810,638 | A * | 9/1998 | Wood | 446/73 |
| 5,816,888 | A | 10/1998 | Myers | |
| 5,924,910 | A * | 7/1999 | Liu | 446/470 |
| D424,632 | S * | 5/2000 | Hollis et al. | D21/548 |
| 6,106,361 | A | 8/2000 | Petris | |
| 6,350,171 | B1 | 2/2002 | Hippely | |
| 6,752,684 | B1 * | 6/2004 | Lee | 446/456 |
| 7,121,917 | B2 | 10/2006 | Hardouin | |
| 2006/0272627 | A1 | 12/2006 | Martinez | |
| 2007/0173174 | A1 * | 7/2007 | Sun et al. | 446/435 |

FOREIGN PATENT DOCUMENTS

JP 08131662 A * 5/1996

* cited by examiner

*Primary Examiner* — Gene Kim
*Assistant Examiner* — Alyssa M Hylinski
(74) *Attorney, Agent, or Firm* — The Mueller Law Office, P.C.

(57) ABSTRACT

This invention sets forth a vehicle launcher assembly comprising an inner vehicle carried within an outer vehicle. The outer vehicle has movable panel components which allow an inner vehicle to be released from the outer vehicle when the panel components are opened. Operation of the toy assembly involves one actuation step to open the panels of the outer vehicle, and second actuation step to launch the inner vehicle. In one embodiment, the outer vehicle is in the form of a car and the inner vehicle is in the form of a motorcycle. The vehicle launcher assembly may also include projectile launchers.

9 Claims, 3 Drawing Sheets

VEHICLE LAUNCHER ASSEMBLY

RELATED APPLICATIONS

This application claims priority to U.S. Provisional Patent Application Serial No. 60/972,798 filed on Sep. 15, 2007 entitled "Vehicle Launcher Assembly," which is hereby incorporated by reference as if set forth in full in this application for all purposes.

BACKGROUND OF THE INVENTION

Toy vehicles that can be launched from another object are a source of amusement for children and adults alike. Some examples of previous vehicle launching platforms include motorcycles launched from carrying cases, aircraft launched from space vehicles, and cars or trucks launched from helicopters, tractors, or other cars. The ways in which a vehicle departs its carrier object have included launching from a split-open front end of a vehicle, exiting the trunk area at the rear of a truck, and dropping from the bottom of a carrier. Regarding the mobility of vehicle launchers, launched vehicles have been configured to be spring-launched from a carrier, to have an independent power source from its mother vehicle, or to be the power source for enabling its carrying vehicle to move. There is a continuing demand for novel features and developments in vehicle launchers to provide new and exciting modes of entertainment.

SUMMARY OF THE INVENTION

This invention sets forth a vehicle launcher assembly comprising an inner vehicle carried within an outer vehicle. The outer vehicle has movable panel components which allow an inner vehicle to be released from the outer vehicle when the panel components are opened. Operation of the toy assembly involves a first actuation step to open the panels of the outer vehicle, and second actuation step to launch the inner vehicle. The outer vehicle is operable as a moving vehicle with or without the inner vehicle enclosed inside. In one embodiment, the outer vehicle is in the form of a car and the inner vehicle is in the form of a motorcycle. The vehicle launcher assembly may also include projectile launchers.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Figure 1:
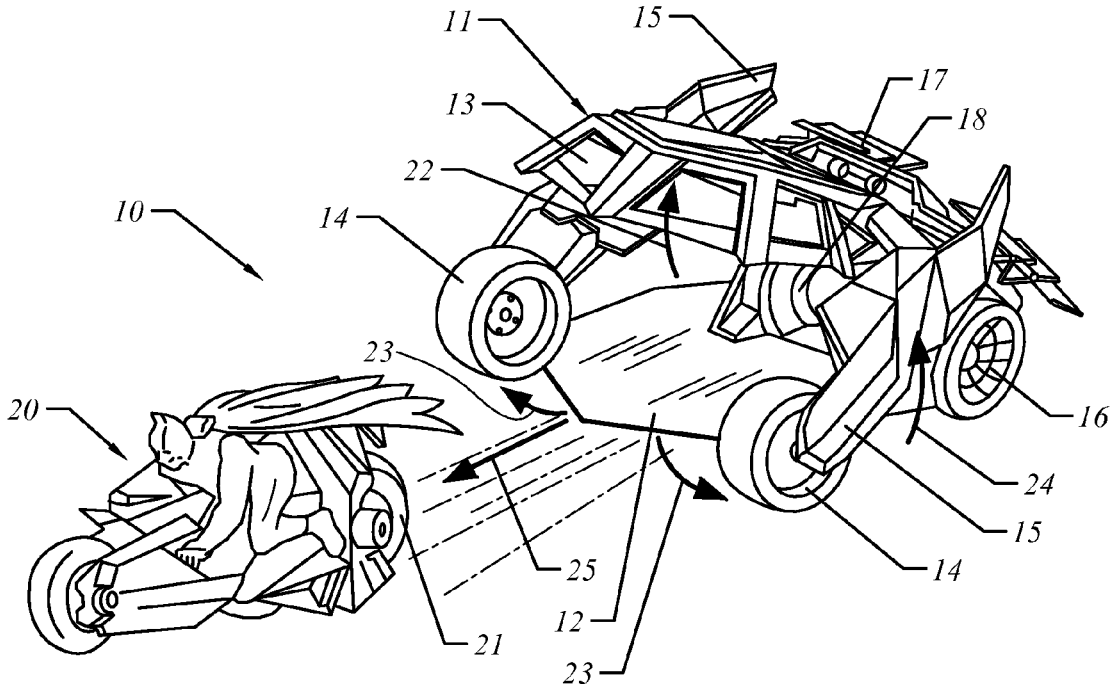
FIG. 1 provides a perspective view of an embodiment of the vehicle launcher assembly with an inner vehicle having been launched.

FIG. 1 provides a perspective view of one embodiment of a vehicle launcher assembly 10 according to the present invention. An outer vehicle 11 of vehicle launcher assembly 10 includes a base 12, a top panel 13 hingedly attached to the rear of base 12, two front wheels 14, two side panels 15 pivotally coupled to front wheels 14, rear wheels 16, a projectile launching bay 17 mounted at the rear of top panel 13, and a launching mechanism 18 mounted on base 12. An inner vehicle 20, depicted here as a motorcycle with a rider, has a back end 21. Back end 21 of inner vehicle 20 mates with launching mechanism 18, which in this embodiment comprises a spring-release mechanism for ejecting inner vehicle 20. The spring-release mechanism may incorporate a compressed spring released by a push button on the rear of outer vehicle 11, not shown in this view of FIG. 1, or may incorporate other means known in the art for releasably ejecting objects. Outer vehicle 11 in FIG. 1 is depicted in an expanded state, in which top panel 13 is pivoted upward as shown by arrow 22, and side panels 15 are swung outward and upward as indicated by arrows 23 and 24, respectively. When outer vehicle 11 is in this expanded state, the inner vehicle 20 may be ejected as depicted by directional arrow 25.

Figure 2:
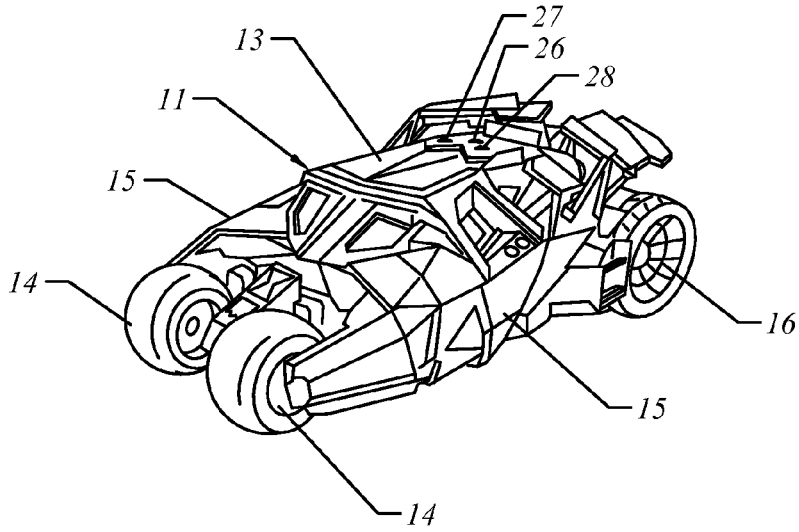
FIG. 2 depicts a perspective view of the outer vehicle of FIG. 1 in a closed state.

FIG. 2 shows a perspective view of the outer vehicle 11 from FIG. 1 in a compacted or closed state, in which top panel 13 and side panels 15 have been manually closed by a user. Alternatively, top panel 13 and side panels 15 may be closed with a lever, button, sliding mechanism or the like, which are mechanically coupled to top panel 13 and side panels 15. In this closed state, outer vehicle 11 takes the form of a car. However, other types of vehicles such as trucks, aircraft, or water vehicles are also possible. The compacted outer vehicle 11 of FIG. 2 may be rolled on its wheels 14 and 16 to be operated as a vehicle either with or without inner vehicle 20 inside. In this view, an actuation button 26, a projectile mode button 27, and a trigger button 28 can be seen on top of outer vehicle 11. To return the outer vehicle 11 of FIG. 2 to an expanded state, the user presses actuation button 26. Actuation button 26 may alternatively take the form of a lever, a rocker switch, or the like. Actuation button 26 is coupled to actuation means within outer vehicle 11 to release top panel 13 and side panels 15 as previously shown by arrows 22, 23, and 24 in FIG. 1. The actuation means for releasing top panel 13 and side panels 15 may comprise means known in the art such as springs, latches, and arm linkages.

To operate the vehicle launcher assembly 10 of FIGS. 1 and 2, a user inserts the inner vehicle 20 into the interior of outer vehicle 11. The user pushes inner vehicle 20 rearward along base 12 until back end 21 engages and locks into launching mechanism 18. The user then closes top panel 13 as well as side panels 15, and may proceed to play with outer vehicle 11 with inner vehicle 20 loaded inside. A user may eject inner vehicle 20 by first pressing actuation button 26 to open outer vehicle 11 to an expanded state. Next, the user presses a release button, not shown, on the rear of outer vehicle 11 to actuate launching mechanism 18. An actuation component, such as a compressed spring or other means known in the art, within launching mechanism 18 propels inner vehicle 20 forward. Once it is released from outer vehicle 11, inner vehicle 20 moves forward under its own inertia. Outer vehicle 11 may additionally include a seat pocket, not shown, within base 12 such that a play figure may be inserted after inner vehicle 20 is launched.

Figure 3:
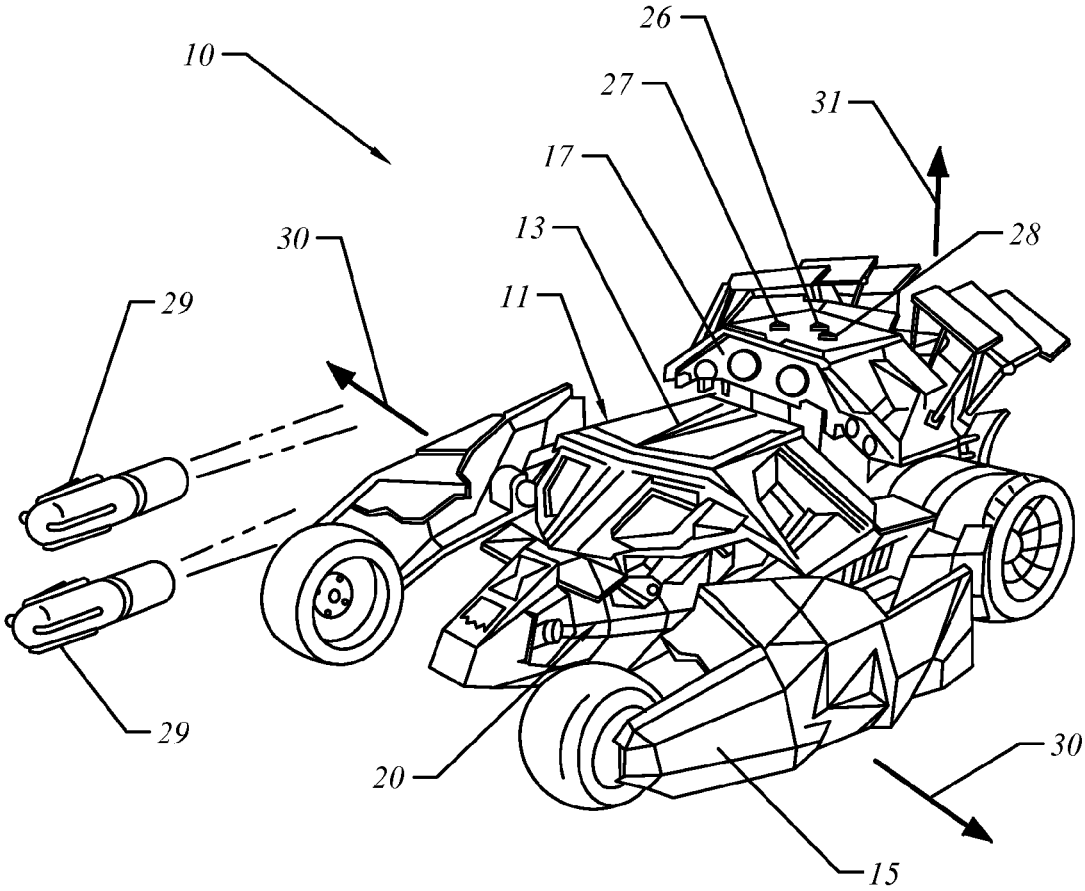
FIG. 3 illustrates a projectile launching mode of the vehicle launcher assembly of FIG. 1.

FIG. 3 shows an additional, optional mode of the vehicle launcher assembly 10 from FIG. 1. The mode shown in FIG. 3 depicts a projectile launching mode, in which a user may launch projectiles 29 from projectile launching bay 17. A user may transform the vehicle launcher assembly 10 from the compacted form of FIG. 2 to the projectile launching mode of FIG. 3 by pressing projectile mode button 27 located on the top of outer vehicle 11. In the projectile launching mode, side panels 15 are displaced outward as shown by the arrows 30, projectile launching bay 17 is extended upward from its stored position as shown by arrow 31, and top panel 13 remains stationary. Inner vehicle 20 is seen to remain inside outer vehicle 11 in this mode. To launch projectiles 29, the user presses trigger button 28 located near projectile mode button 27. Although this embodiment of FIG. 3 is configured to launch two projectiles 29, it may be configured to house only one projectile or more than two, as allowed by the space available within projectile launching bay 17. In the case where multiple projectiles 29 are present, a single trigger button 28 may launch all projectiles simultaneously, or multiple trigger buttons 28 may be utilized to individually control each projectile. Furthermore, a single trigger button 28 may be coupled to an indexing mechanism to launch projectiles 29 sequentially.

Figure 4:
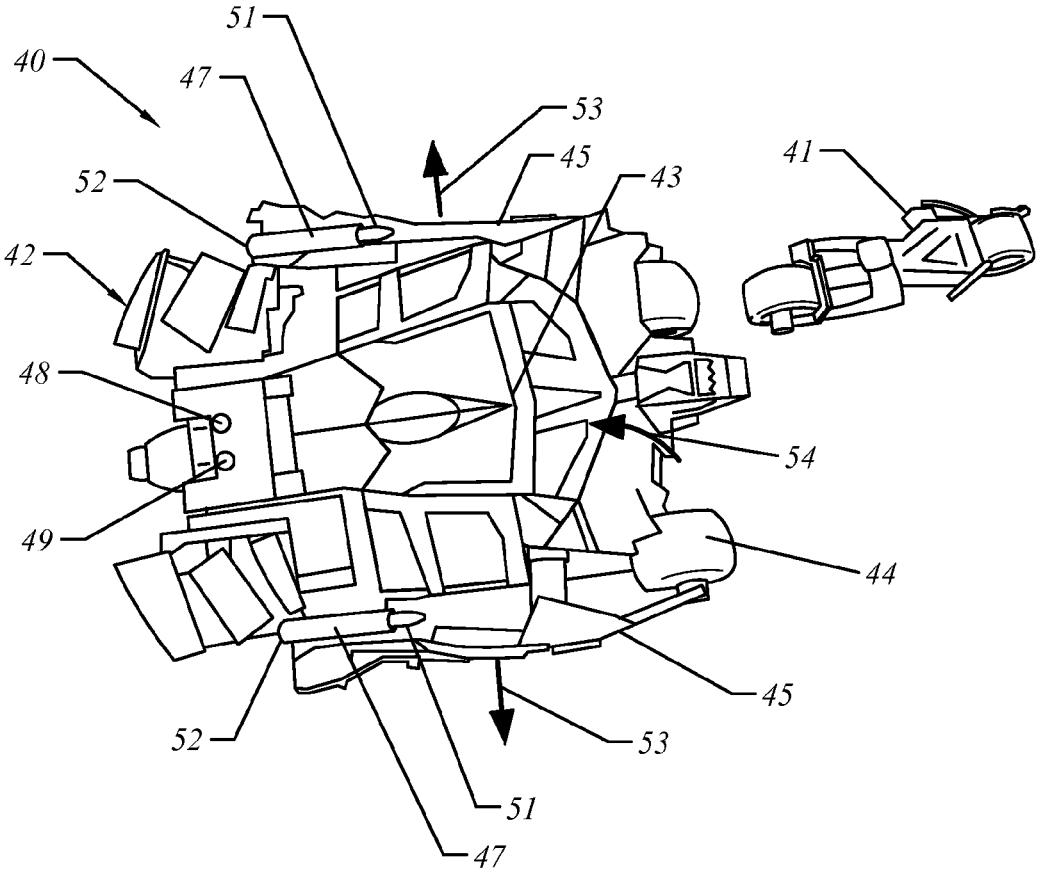
FIG. 4 is a top view of another embodiment according to the present invention, in which the outer vehicle is expanded.

FIG. 4 depicts another embodiment according to the present invention, in which side panels shift laterally outward rather than angling outward and upwardly as in the embodiment of FIG. 1. Similar to vehicle launcher 10 of FIG. 1, this vehicle launcher assembly 40 of FIG. 4 comprises an inner vehicle 41 and an outer vehicle 42, with outer vehicle 42 including a top panel 43, a plurality of wheels 44, and side panels 45. However, side panels 45 shift laterally outward as indicated by arrows 53. Additionally, outer vehicle 42 includes a launching tube 47 above each side panel 45, and also includes an actuation button 48 and a launching button 49 at the rear of outer vehicle 42. A projectile 51 is loaded into each launching tube 47, and each launching tube 47 further includes a back end 52. Launching tubes 47 may include a trigger button, not shown, located at back end 52 for launching projectiles 51. The outer vehicle 42 of FIG. 4 is shown in an expanded state in which side panels 45 are displaced laterally outward as shown by arrows 53, and the front of top panel 43 hinges upwardly as shown by arrow 54.

Figure 5:
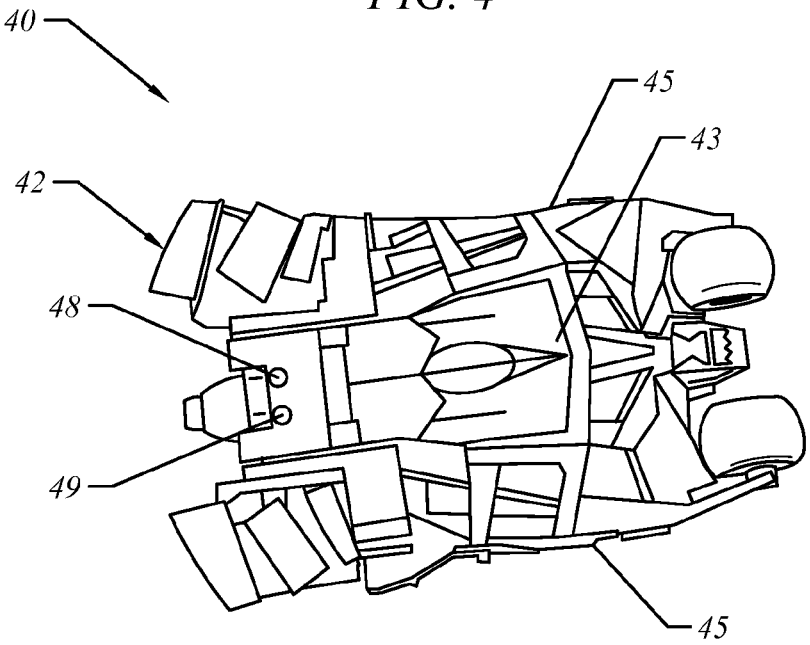
FIG. 5 provides a top view of the outer vehicle of FIG. 4 in a closed state.

FIG. 5 shows the corresponding closed outer vehicle 42 from FIG. 4, in which a user has manually closed side panels 45 and top panel 43 by pushing them inward and downward, respectively. Alternatively, top panel 43 and side panels 45 may be closed using a lever, a button, or the like mechanically coupled to top panel 43 and side panels 45. With the inner vehicle 41 loaded inside outer vehicle 42, a user operates the vehicle launcher assembly 40 by first pressing actuation button 48. Pressing actuation button 48 causes top panel 43 and side panels 45 to open to the expanded state of FIG. 4. When the launching button 49 is pressed, a spring-release mechanism within the outer vehicle 42 is released, and the inner vehicle 41 is launched from outer vehicle 42. Inner vehicle 41 and outer vehicle 42 may operate independently using their own set of wheels, or outer vehicle 42 may be operated with inner vehicle 41 encased inside. The interior of outer vehicle 42 may be configured with a seat pocket to accommodate a play figure when inner vehicle 41 is not occupying the interior of outer vehicle 42.

The present invention may include variations of the movable top and side panels which have been disclosed. For instance, a side panel of the outer vehicle may have a hinged joint across its width so that it accordion-folds when actuated. In another example, a top panel may be split along its length such that its two halves rotate outwardly rather than upwardly as previously described. Furthermore, while the figures depict the invention in the form of wheeled vehicles, other types of vehicles such as spacecraft and water vehicles are applicable.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A vehicle launcher assembly, comprising:

an outer vehicle, comprising:

a base;

a launching mechanism mounted to the base;

a top panel pivotally coupled to the base, wherein the top panel has a closed position covering the base and an open position pivoted upward from the base;

two side panels movably coupled to the base, wherein the side panels have a first position adjacent to the base and a second position wherein a perimeter of the side panels is displaced laterally outwardly and rotated upwardly from the base;

a first actuation button to move the top panel from the closed position to the open position and to move the side panels from the first position to the second position; and a second actuation button to control actuation of the launching mechanism after the first actuation button has been actuated; and an inner vehicle releasably coupled to the launching mechanism.

2. The vehicle launcher assembly of claim 1, wherein the outer vehicle further comprises a plurality of wheels supporting the outer vehicle.

3. The vehicle launcher assembly of claim 2, wherein the outer vehicle is a car and the inner vehicle is a motorcycle.

4. A vehicle launcher assembly, comprising:

an outer vehicle, comprising:

a base;

a launching mechanism mounted to the base;

a top panel pivotally coupled to the base;

two side panels movably coupled to the base;

a projectile launcher mounted to the top panel; and an inner vehicle releasably coupled to the launching mechanism;

wherein the outer vehicle has a first actuation mode in which a perimeter of the side panels is displaced laterally outward from the base; and wherein the outer vehicle has a second actuation mode in which the perimeter of the side panels are displaced laterally outward and rotated upwardly from the base.

5. The vehicle launcher assembly of claim 4, wherein the inner vehicle is released in conjunction with the first actuation mode.

6. The vehicle launcher assembly of claim 4, wherein the projectile launcher is extendable from the top panel, and wherein the projectile launcher is extended in conjunction with the second actuation mode.

7. The vehicle launcher assembly of claim 4, wherein the outer vehicle is a car and the inner vehicle is a motorcycle.

8. The vehicle launcher assembly of claim 1, wherein the perimeter of the side panels is rotated upwardly in a plane of the side panels.

9. The vehicle launcher assembly of claim 4, wherein the perimeter of the side panels is rotated upwardly in a plane of the side panels.

* * * * *